US005771518A

United States Patent [19]

Roberts

[11] Patent Number: 5,771,518

[45] Date of Patent: Jun. 30, 1998

[54] PRECAST CONCRETE BRIDGE STRUCTURE AND ASSOCIATED RAPID ASSEMBLY METHODS

[76] Inventor: Michael Lee Roberts, 2516 Craig La., Denton, Tex. 76201

[21] Appl. No.: 408,457

[22] Filed: Mar. 22, 1995

Related U.S. Application Data

[63] Continuation of Ser. No. 291,246, Aug. 16, 1994, abandoned, which is a continuation of Ser. No. 367,357, Jun. 16, 1989, abandoned.

[51] Int. Cl.[6] ..... E01D 21/00; E01D 19/02; E01D 19/06

[52] U.S. Cl. ..... 14/73.1; 14/75; 14/77.1; 14/77.3

[58] Field of Search ..... 14/1, 4, 6, 13, 14/14, 16.1, 17, 73, 75, 77; 404/1; 405/225, 233, 236, 244; 52/259, 585, 698, 704, 722, 723, 744, 745, 251; 156/91, 293, 294, 305

[56] References Cited

U.S. PATENT DOCUMENTS

| | | | |
|---|---|---|---|
| 189,020 | 4/1877 | Colby | 14/75 |
| 2,602,321 | 7/1952 | Blair | 14/75 X |
| 2,875,584 | 3/1959 | Turzillo | 405/229 |
| 3,151,464 | 10/1964 | Sato et al. | 405/236 |
| 3,213,768 | 10/1965 | Jensen | 14/73 X |
| 3,438,212 | 5/1969 | Turzillo | 405/236 |
| 3,780,484 | 12/1973 | Muze | 52/585 |
| 3,794,433 | 2/1974 | Schupack | 404/1 |
| 3,906,687 | 9/1975 | Schupack | 52/87 |
| 3,992,890 | 11/1976 | Pryke | 405/232 |
| 4,014,174 | 3/1977 | Mondshine | 405/233 |
| 4,051,570 | 10/1977 | Hilfiker | 14/26 |
| 4,181,995 | 1/1980 | Zur | 14/1 |
| 4,231,683 | 11/1980 | Vanderline | 405/244 X |
| 4,259,759 | 4/1981 | Tada | 14/16.1 |
| 4,295,761 | 10/1981 | Hansen | 405/261 |
| 4,305,172 | 12/1981 | Watson | 14/16.1 |
| 4,320,548 | 3/1982 | Tada et al. | 14/1 |
| 4,482,384 | 11/1984 | Miller | 106/664 |
| 4,618,289 | 10/1986 | Federer | 405/236 |
| 4,808,038 | 2/1989 | Roberts et al. | 405/237 |
| 4,907,916 | 3/1990 | Hartman | 405/236 |

FOREIGN PATENT DOCUMENTS

| | | | |
|---|---|---|---|
| 796262 | 6/1958 | United Kingdom | 405/236 |

*Primary Examiner*—Hoang C. Dang
*Attorney, Agent, or Firm*—McKinney & Stringer, P.C.

[57] ABSTRACT

A pier and beam bridge structure is formed essentially entirely from steel reinforced, precast concrete elements including elongated, hollow tubular pier members, pier collars, pier base and cap beams, deck beams, deck slabs and side railing members. In forming the support pier structures, the pier members are inserted into dry-drilled pier base excavations through opposite end openings formed in the ground-supported base beams, and are outwardly circumscribed by the collars which are received at their opposite ends in the base beam end openings and openings in the cap beams which are supported at the upper pier ends. A loose aggregate material is dumped into the pier member interiors, and the annular collar and excavation spaces surrounding the pier members. Polymer concrete is then forced downwardly through the pier member interiors, and upwardly through these annular spaces, and cures in a matter of minutes to complete the fabrication of each pier structure. The precast deck beams, deck slabs and railing members are then sequentially installed and rapidly interconnected using hollow connecting pin members inserted into aligned openings formed in abutting concrete surfaces and grouted into place using a quick-setting polymer concrete.

42 Claims, 4 Drawing Sheets

PRECAST CONCRETE BRIDGE STRUCTURE AND ASSOCIATED RAPID ASSEMBLY METHODS

This application is a continuation of application Ser. No. 08/291,246, filed Aug. 16, 1994, now abandoned, which was a continuation of application Ser. No 07/367,357, filed Jun. 16, 1989, now abandoned, the contents of which are incorporated herein by reference.

BACKGROUND OF THE INVENTION

The present invention relates generally to the construction of concrete pier-and-beam bridges. In a preferred embodiment thereof, the present invention more particularly provides an improved pier-and-beam bridge structure formed essentially entirely from steel reinforced, precast concrete pier, beam and deck slab elements which are factory fabricated under controlled conditions, shipped to the bridge construction site, and very rapidly set in place and interconnected using a quick-setting polymer concrete material as a bonding and support agent.

As is well-known, the construction of cast-in-place concrete pier and beam bridge structures, for example at grade crossings, is a very labor intensive, time consuming, and expensive undertaking—a task which typically requires the presence of a large construction crew, and associated heavy equipment, for months at the bridge site before construction of the bridge is completed. This inordinate time requirement flows from the previous necessity of forming the various bridge components on-site by hand-constructing wooden forms, pouring concrete into the forms to fashion sections of the various bridge components, allowing sufficient time (sometimes days) for the sections to cure, dismantling the forms, and starting the process over again.

For example, in the formation of the bridge piers (the horizontally spaced vertical elements which support the actual roadway portion of the bridge), this form, pour and cure sequence must typically be performed many times for each pier element as it is constructed, in vertical sections, from the ground up. A similar form, pour and cure technique must then be employed for the upper beam and slab portions of the bridge.

Not only does this conventional concrete bridge building method continuously tie up a large construction crew, and associated heavy equipment, for months at a time, but great care must also be taken to assure that each successively poured and cured section of concrete is of the necessary quality and strength. This is often difficult due to the successive batches of concrete which must be mixed, and then poured and cured, under often varying climatic conditions.

In view of the foregoing, it is accordingly an object of the present invention to provide an improved concrete pier-and-beam bridge structure, and associated fabrication methods therefor, which eliminates or minimizes the above-mentioned and other problems, limitations and disadvantages associated with conventional cast-in-place concrete bridge structures.

SUMMARY OF THE INVENTION

In carrying out principles of the present invention, in accordance with a preferred embodiment thereof, a bridge structure may be very rapidly erected essentially entirely from factory prefabricated, steel reinforced concrete components which are set in place and interconnected at the construction site using a quick-setting grout material such as polymer concrete. The precast concrete bridge components include tubular pier members and associated external collars, pier base and cap beams, deck beams, deck slabs and guardrail members. Using the installation and assembly methods of the present invention even a relatively large bridge may be erected in a matter of days, as opposed to the months-long construction periods typically associated with cast-in-place concrete bridge structures.

Spaced apart pier portions of the prefabricated concrete bridge structure are rapidly formed by leveling the earth surface at each pier location and spreading gravel over the leveled areas. Each gravel pile is mechanically tamped and grout stabilized to level its upper surface, upon which a pier base beam is placed. Pier foundation holes are dry-drilled at each base beam end using, for example, a conventional rat hole drilling bucket lowered through countersunk holes formed vertically through the opposite base beam ends and having annular, upwardly facing internal ledge portions.

When each of the two pier foundation holes at each base beam has been drilled to a predetermined depth, lower end portions of two of the pier members are extended downwardly into the foundation holes through the base beam end openings. The tubular pier members have outer diameters somewhat smaller than the diameters of the beam end openings and the dry-drilled foundation holes, whereby annular spaces are formed around the longitudinal pier member portions extending through the base beam openings and into the foundation holes.

These annular spaces are upwardly extended by slipping one of the collar members over each upwardly projecting pier member portion, the bottom end of each installed collar being closely received within one of the countersunk areas of a base beam end opening and resting on its annular ledge area. Each tubular pier member is shipped to the bridge site in a length somewhat longer than necessary, and is field cut to a length which positions its upper end just slightly below the upper end of its installed collar. Metal shims are installed on the upper end of each field-cut pier member to position the upper side surface of the uppermost shim precisely level with the top end surface of the associated pier member collar.

Prior to the installation of a cap beam atop the upper ends of the pier members and collars projecting upwardly from the opposite base beam ends, the two annuluses surrounding the pier members, and extending along their entire lengths, and the interiors of the tubular pier members, are filled with a loose aggregate material. The aggregate material is settled into a point-to-point orientation within the annuluses and the pier member interiors by, for example, suitably vibrating the pier structures.

Suitable elastomeric bearing pads, with openings communicating with the annuluses and pier member interiors, are then placed on the upper ends of the pier members and their associated collars. A cap beam is then set into place atop the upper pier member and collar ends, by inserting such upper ends into circular end openings extending upwardly through the bottom side surface of the cap beam and terminating in its interior. Small fill openings are formed downwardly through the upper side surface of the cap beam and communicate, through the bearing pad openings, with the pier member interiors and the pier annuluses. These fill openings are also packed with stone aggregate material.

To complete the rapid construction of each pier structure (i.e., a base beam, two pier members, two collars and a cap beam), a quick-setting grout (preferably a polymer concrete material) is forced downwardly through two of the cap beam fill holes and into the interiors of the pier members. When the polymer concrete reaches the bottom of a pier member, it forces its way around its bottom end and flows upwardly through and fills the associated aggregate-containing annulus. The injected polymer concrete, flowed through the aggregate material, completely cures within an hour or less and firmly locks the assembled precast pier components into place. Locked into place in this manner, the base beam portions of the pier structures are converted into spread footings which distribute the vertical pier load along an extended horizontal earth surface portion. The rapidly cured aggregate/polymer concrete mixture portion within the foundation holes also provides an intimate, vertical load-supporting frictional contact between the pier structure and the interior earth surface. This vertical load support ability of the cured aggregate/polymer concrete mixture is further enhanced by the upward annulus extensions defined by the pier collar members which also serve to shield the above-ground portions of the main pier members.

The pier structure fabrication technique of the present invention completely eliminates the previous necessity of forming bridge support piers by the laborious cast-in-place method in which successive vertical sections of each pier are formed, poured and cured - a process usually entailing waiting periods of several days to cure each vertical pier section before the next section can be poured. Additionally, because the pier components (like the other components) of the present invention are factory precast, under controlled conditions, the resulting pier structures are of uniformly high quality and strength regardless of the vagaries of climatic conditions during bridge construction.

The remaining portions of the bridge structure extending between the upper ends of each adjacent pair of finished pier assemblies are each assembled by first placing the opposite ends of a laterally spaced series of deck beams on the cap beams of the two pier assemblies so that the deck beams span the bridge portion in a direction parallel to the bridge length. Hollow metal connecting pins are placed in aligned, larger diameter circular openings formed vertically through the cap and deck beams. Polymer concrete is then forced downwardly through the interiors of the connecting pins, and then upwardly through the beam hole annuluses around the pins. The injected polymer concrete very rapidly cures (in a matter of minutes) to strongly and permanently interlock the pier cap and deck beams.

Next, a side-to-side series of deck slabs (which define the actual elevated roadway surface of the bridge structure) are placed transversely atop the installed deck beams, and hollow connecting pins are vertically placed in aligned, larger diameter circular holes formed in the deck beams and slabs. Polymer concrete is then injected downwardly through these pins and upwardly through their associated hole annuluses. Finally, this pin and quick-setting grout connection technique is used to secure upstanding, precast guardrail members to the outer ends of the installed deck slabs.

It can be readily seen from the foregoing that the use in the present invention of precast components, coupled with the use of quick-setting grout material as an installation and interconnecting medium, provides for the considerably faster and less expensive construction of a concrete pier-and-beam bridge structure of uniformly high quality and strength.

DETAILED DESCRIPTION

Figure 1:
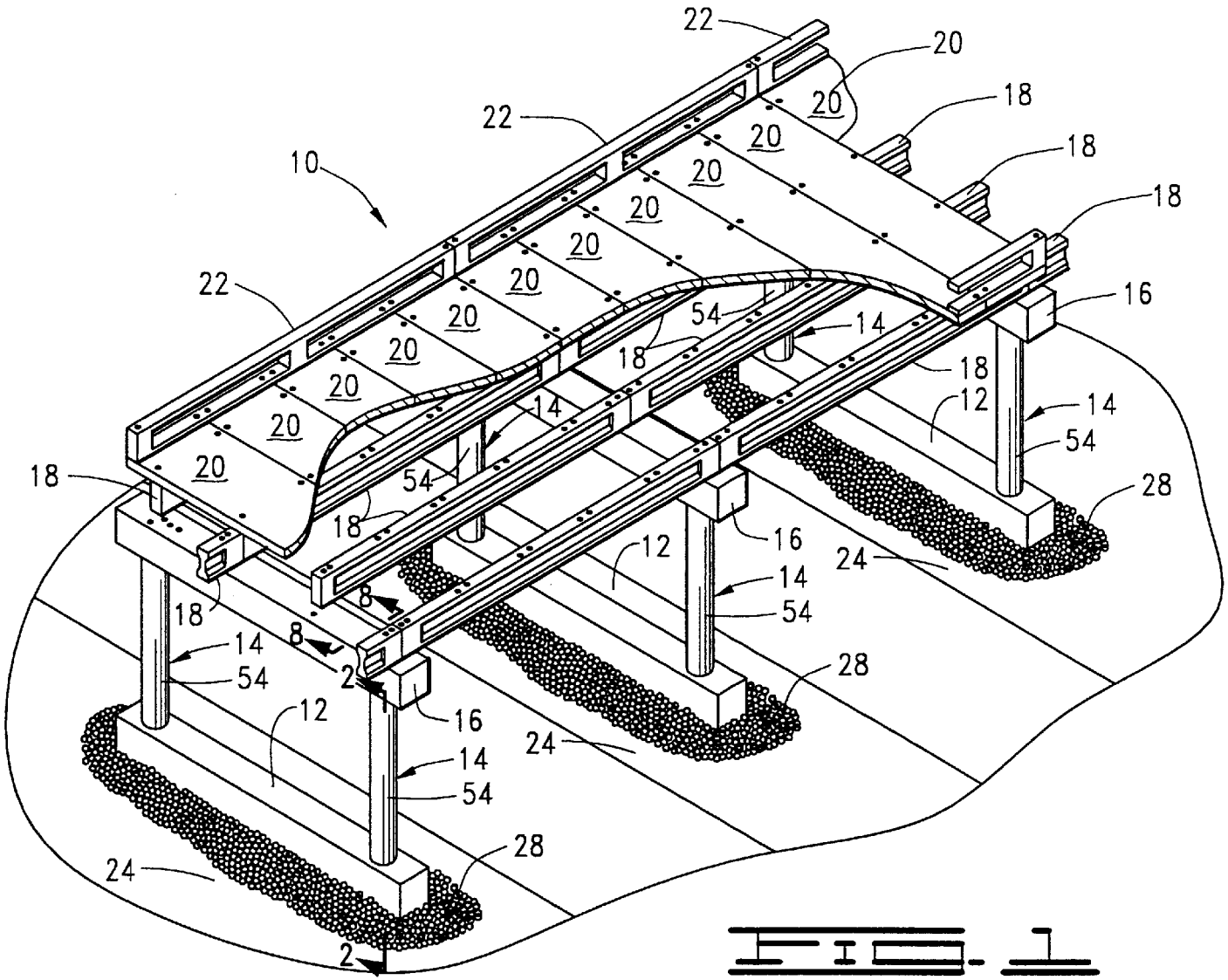
FIG. 1 is a simplified, partially cut-away perspective view of a longitudinal portion of a precast concrete road grade crossing bridge structure incorporating principles of the present invention.

Perspectively illustrated in FIG. 1 is a longitudinal portion of a grade crossing bridge structure 10 that embodies principles of the present invention. The bridge structure 10 is uniquely constructed essentially entirely from steel reinforced, precast concrete sections including pier base beams 12, support pier structures 14, pier cap beams 16 supported on the upper ends of the pier structures and extending parallel to the base beams 12, laterally spaced bridge deck beams 18 supported on the upper sides of the pier cap beams 16 an extending transversely thereto, side-by-side deck slabs 20 supported on the deck beams 18 and extending transversely thereto, and guardrail members 22 secured to and projecting upwardly from the outer ends of the deck slabs 20, and extending parallel to the length of the bridge. Each of these structural elements of the bridge 10 is factory fabricated, under carefully controlled conditions, to form very high quality precast concrete bridge elements which are shipped to the bridge site and rapidly incorporated in the bridge structure in a unique manner subsequently described in detail herein. As previously mentioned, each of these precast concrete components is internally reinforced with the usual metal rods, such rods having been omitted throughout the drawings for purposes of illustrative clarity.

Figure 2:
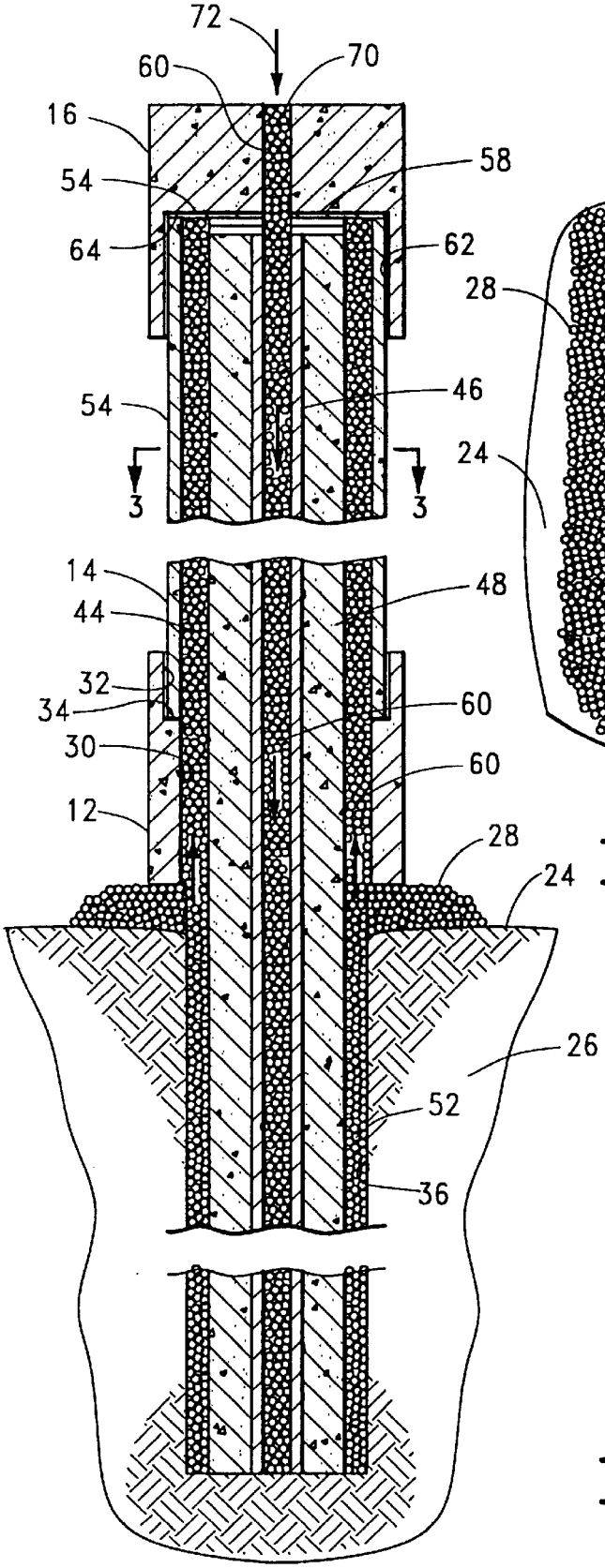
FIG. 2 is an enlarged scale, vertically foreshortened cross-sectional view through a support pier portion of the bridge structure taken generally along line 2—2 of FIG. 1.
Figure 3:
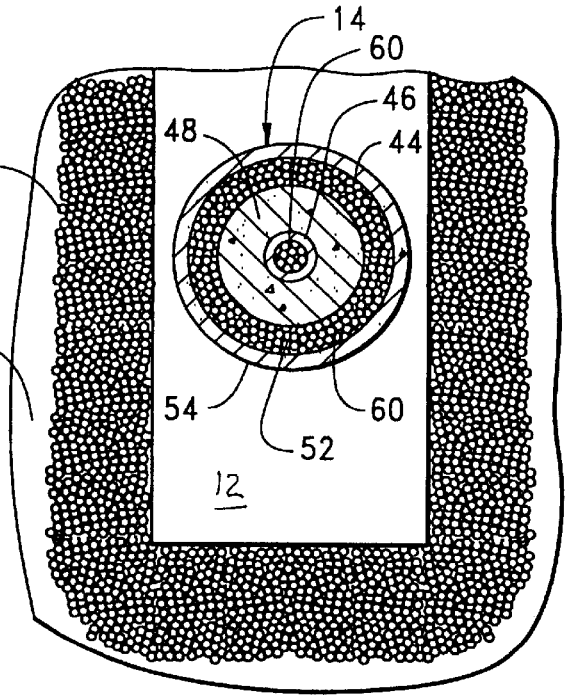
FIG. 3 is a cross-sectional view through the support pier portion taken along line 3—3 of FIG. 2.
Figure 5:
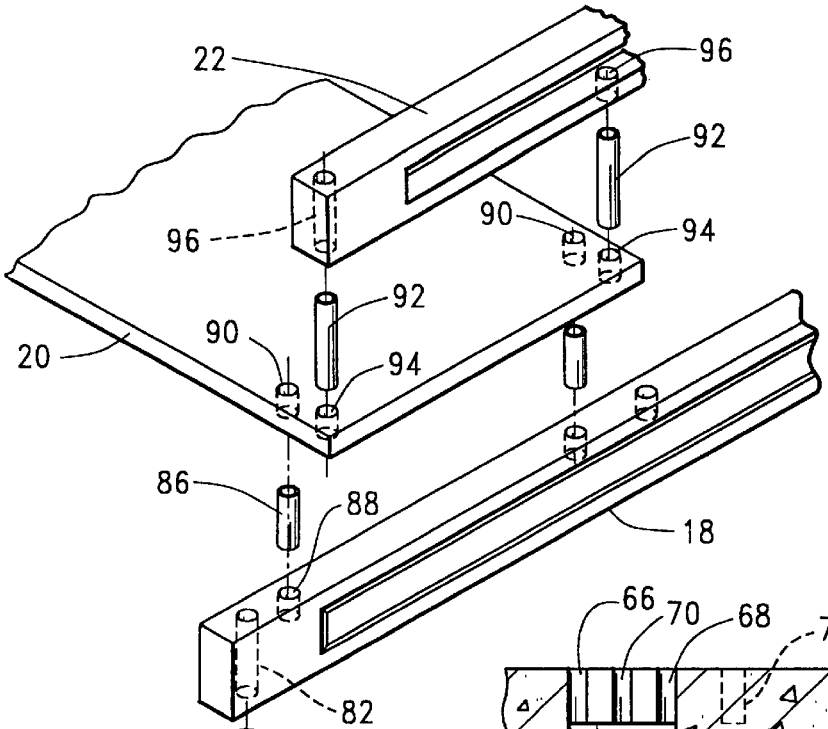
FIG. 5 is an enlarged scale exploded perspective view of interconnected precast concrete beam, deck and railing portions of the bridge structure.
Figure 5:
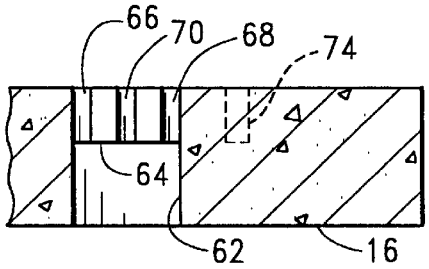
Figure 7:
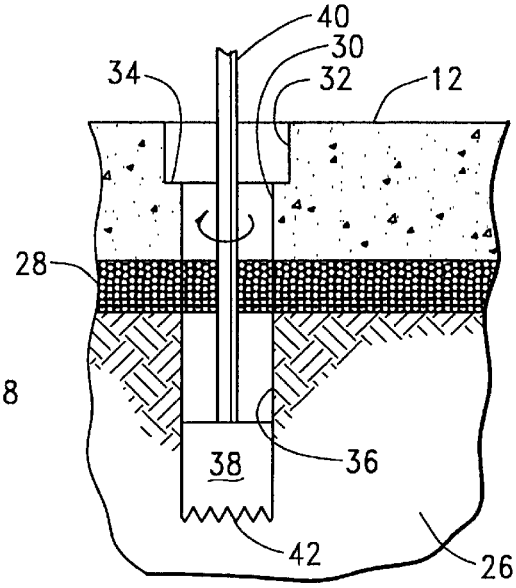
FIG. 7 is a cross-sectional view taken along line 7—7 through the pier base beam end portion illustrated in FIG. 5, and schematically depicts the dry-drilling formation of a pier foundation hole.

Referring now to FIGS. 1–3, the assembly of the bridge 10 is initiated by leveling spaced apart surface portions 24 of the earth 26, and placing gravel piles 28 on the leveled surfaces 24, each of the gravel piles 28 being somewhat longer and wider than the pier base beams 12. The top surface of each gravel pile 28 is then mechanically tamped to level it. A pier base beam 12 is then positioned atop its associated gravel pile 28, and the gravel is grout stabilized. As best illustrated in FIGS. 5 and 7, each of the base beams 12 has a circular opening 30 formed vertically through each of its opposite ends, the openings 30 having enlarged diameter countersunk upper end portions 32 that form within the beam annular, downwardly inset ledges 34.

With a base beam 12 positioned atop a tamped gravel pile 28, a dry-drilled pier foundation hole 36 (FIGS. 2 and 7) is formed at each of the beam ends using, for example, a conventional rat hole drilling bucket 38 (FIG. 7) which may be conveniently lowered through the beam end openings 30 and rotated on its supporting shaft structure 40 to progressively extend the pier foundations holes 36 to their desired depths. As can be seen, the pier base beams 12 thus are used, in effect, as drilling templates at each foundation portion of the bridge structure. In this way, the digging tool is placed at a selected location and guided while digging so that the pier foundation hole extends vertically into the earth at the selected location. As is customary, the drilling bucket 38 is provided at its lower end with cutting teeth 42 and has a bottom end trap door mechanism (not shown) which permits the drilled out earth to upwardly enter the bucket, and closes when the bucket is lifted to progressively drill out the hole 36. Other dry drilling structures could be alternatively employed, and lowered through the beam end openings 30, if desired.

Figure 4:
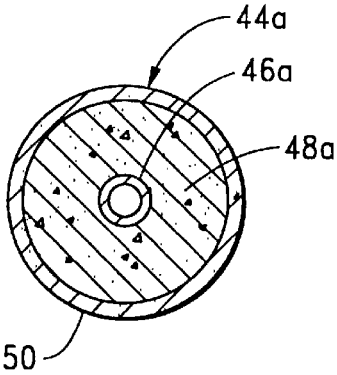
FIG. 4 is a vertically directed cross-sectional view through an alternate embodiment of the main support pier member illustrated in FIGS. 2 and 3.

With the pier foundation holes 36 at the opposite ends of a base beam 12 formed to their desired depths, main pier element portions 44 of the overall pier structure 14 are lowered into the holes 36 through the base beam openings 30. In the preferred embodiment thereof, each of these main pier elements 44 is of a hollow tubular configuration defined by a central metal pipe 46 around which a tubular, steel reinforced precast concrete section 48 is formed. An alternative embodiment $\mathbf{44}_a$ of the main pier element 44 is cross-sectionally illustrated in FIG. 4 and comprises a central metal pipe $\mathbf{46}_a$ surrounded by steel reinforced, precast annular concrete section $\mathbf{48}_a$ circumscribed by an outer metal jacket pipe 50. As a further alternative, a thick-walled metal pipe could be used by itself as a main pier element.

As illustrated in FIGS. 2 and 3, the pier element 44 is somewhat smaller in outer diameter than the diameter of the base beam opening 30 through which it downwardly extends, and is also smaller in diameter than the dry-drilled hole 36 which receives a lower portion thereof. This dimensioning defines an annular fill space 52 defined between the outer side surface of the pier element 44 and the side surfaces of the beam opening 30 and the foundation hole 36. This annular space 52 is extended upwardly beyond the base beam 12 by means of a tubular, steel reinforced precast concrete collar member 54 which is slipped over the upper end of the pier element 44 and has a lower end which is received in the countersunk beam hole portion 32 and rests upon the beam opening ledge 34 as best illustrated in FIG. 2. As also illustrated in FIG. 2, the upper end of the concrete collar 54 is generally aligned with the upper end of the main pier element 44.

Each of the main pier elements 44 is shipped to the bridge site in a length somewhat longer than actually needed, and is longitudinally cut to size (in a length just slightly shorter than needed) at the construction site. To precisely align the effective upper end of the main pier element 44 with the upper end of the collar 54, one or more annular metal shims 56 are positioned atop the upper end of the pier element 44 as shown in FIG. 2. When the shimming operation is complete an elastomeric bearing pad 58 is positioned on the upper ends of each of the two shimmed pier elements 44 and their associated collars 54.

The entire annular space 52, and the interior of the central pipe 46 is filled with a loose aggregate material 60 which is settled into a compacted, point-to-point orientation by, for example, suitably vibrating the pier structures 14 as the aggregate is being dumped into the annulus and the central pipe interior.

Figure 6:
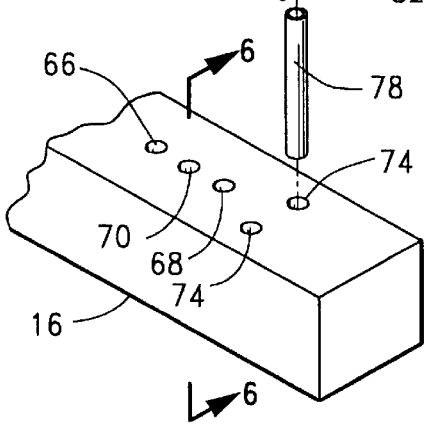
FIG. 6 is a cross-sectional view taken along line 6—6 through the pier cap beam end portion illustrated in FIG. 5.
Figure 6:
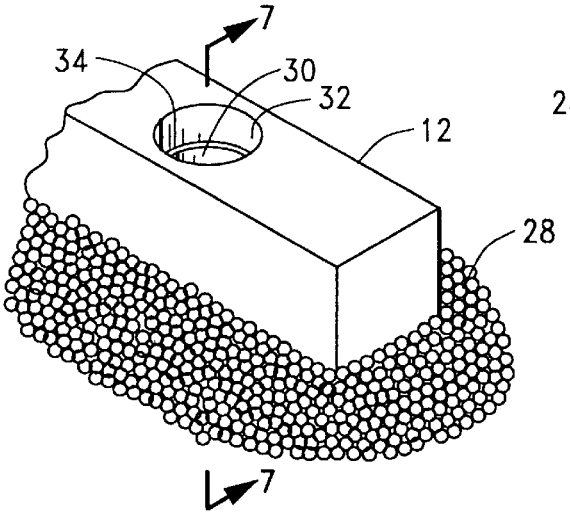

As illustrated in FIGS. 2 and 6, the bottom side of each of the pier cap beams 16 has formed therethrough, adjacent its opposite ends, an upwardly extending circular opening 62 sized to receive an upper end portion of one of the collars 54. Each opening 62 has an upper end surface 64 through which three smaller diameter circular openings extend to the upper side surface of the beam 16.

Each pier cap beam 16 is supported on the upper end of two of the pier structures 14 by lowering the opposite ends of the cap beam onto the upper pier structures ends so that upper end portions of the collars 54 are received within the beam end openings 62 as illustrated in FIG. 2. With the cap beam 16 supported on the pier structures in this manner, the upper ends of the two collars 54, and the uppermost shims 56, engage and support the upper end surfaces 64 of the beam openings 62 and compress the elastomeric bearing pads 58. At each cap beam end, the small circular beam openings 66 and 68 communicate with the annulus 52 via suitable openings formed in the bearing pad 58, and the circular beam opening 70 communicates with the interior of the central pipe 46 through a central opening in the bearing pad 58. With the cap beam in place, its end openings 68, 68 and 70 are filled with additional aggregate 60.

Finally, a quick-setting grout, preferably a polymer concrete material 72, is forced downwardly through the two circular end openings 70 in the cap beam 16, through the interiors of the central pipes 46, around the lower ends of the main pier elements 44, and upwardly through the annuluses 52 to the tops of the beam openings 66 and 68. The injected polymer concrete material 72, flowed through the aggregate 60, cures completely within an hour or less, thereby very quickly readying the interconnected base beam, cap beam and pier structure portions of the bridge for connection thereto of the remaining deck beam, deck slab and guard-railing portions of the bridge in a manner subsequently described.

The hardened aggregate/polymer concrete material within the annuluses 52 very firmly supports the main pier elements 44 within their foundation holes 36, and firmly anchors each pair of pier structures 14 to their associated base beam 12 so that it forms a spread footing portion of the overall bridge structure. The aggregate/polymer concrete-filled upward extensions of the annuluses 52, within the collars 54, function to further stabilize the pier structure and transfer a portion of its vertical load to such spread footing structure. The rapidity with which the pier portions of the overall bridge structure may be constructed, utilizing the polymer concrete grout material, very significantly reduces the overall time required to construct the bridge 10. Additionally, since the base beams 12, the pier structures 14, and the cap beams 16 were previously fabricated in a factory setting, under carefully controlled conditions, a uniformly high quality of pier construction is also advantageously achieved.

While the hollow tubular pier member configuration provides a convenient central passage through which the quick-setting grout may be flowed into the annular fill space, the pier members could alternatively be of a solid configuration in which case the grout could be directly flowed into the annular fill space through, for example, a suitable fill tube (not shown) inserted downwardly into the fill space.

Figure 8:
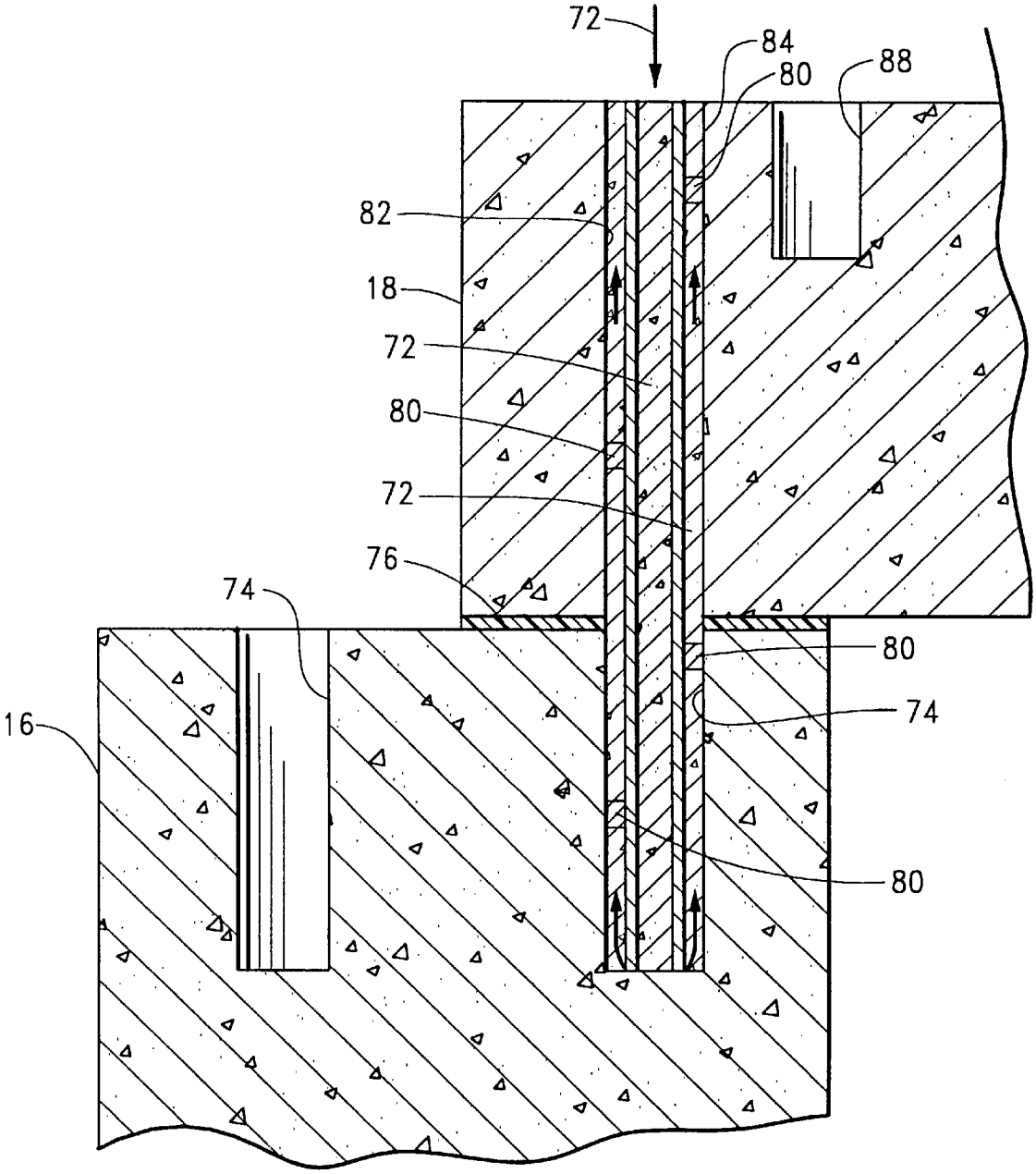
FIG. 8 is an enlarged scale partial cross-sectional view through pier cap and deck beam portions of the bridge structure and illustrates the interconnection between such beam portions.

Referring now to FIGS. 1, 5 and 8, with two or more base beam, pier structure and cap beam subassemblies in place, the prefabricated deck beams 18 may be set in place across two adjacent pier cap beams as best illustrated in FIG. 1. To facilitate the rapid interconnection between these deck beams 18 and their underlying pier cap beams 16, longitudinally spaced pairs of circular openings 74 are extended downwardly into the upper side surface of each of the pier cap beams 16. Prior to the setting of the deck beams 18 on the pier cap beams 16, suitable elastomeric bearing pads 76 (FIG. 8) are placed atop the pier cap beams, and the lower ends of hollow metal connecting pins 78 are inserted downwardly into the beam openings 74 through aligned openings in the bearing pads 76.

As best illustrated in FIG. 8, each of the connecting pins 78 is of a smaller diameter than the diameter of its associated beam openings 74, and the pin may be conveniently held in alignment with its opening 74 by means of small spacing elements 80. An end of each of the deck beams is lowered onto the bearing pad on the upper surface of one of the pier cap beams 16 so that the upwardly projecting portion of one of the connecting pins 78 is passed upwardly through a circular opening 82 extending upwardly through the deck beam 18, each of the openings 82 being of the same diameter as its underlying beam opening 74. Additional spacing elements 80 may be utilized to hold the connecting pin 78 centrally within the deck beam opening 82.

As illustrated in FIG. 8, the connecting pin 78 forms with the interiors of the beam opening 74 and 82 an annular space 84 which extends from the bottom end of the beam opening 74 to the top side surface of the deck beam 18. To very rapidly and permanently intersecure the ends of each of the deck beams 18 to its underlying cap beam portion, polymer concrete 72 is forced downwardly through the interior of the pin member 78, is flowed around its lower end, and is forced upwardly through the annulus 84 to fill the same. The injected polymer concrete material cures within a matter of minutes to permanently anchor the deck beam ends to their associated pier cab beams.

This same rapid and very efficient connection method is also used to subsequently intersecure the deck slabs 20 to the upper sides of the deck beams 18, and then secure the guardrail members 22 to the outer ends of the deck plate 20. Specifically, to rapidly intersecure the deck slabs 20 to the deck beams 18, hollow connecting pin members 86 (FIG. 5) are positioned in corresponding circular openings 88 formed in the upper side surface of each of the deck beams 18, and extended upwardly through aligned openings 90 formed entirely through the deck slabs 20. Polymer concrete is then forced downwardly through the in-place pins 86 and flowed upwardly through the annulus which they define with the interior side surfaces of the aligned deck beam and slab openings 88 and 90. Finally, using this same quick-setting pin connection technique, hollow connecting pins 92 are inserted into aligned circular openings 94 and 96 formed in the deck slabs 20 and guardrail members 22, and grouted into place using the same polymer concrete material. Using this rapid pin and grouting technique, the entire upper portion of the bridge structure 10 may be quite rapidly constructed.

It can readily be seen from the foregoing that the present invention provides a very rapid and relatively simple method of constructing a pier and beam bridge structure using very simple precast concrete components. The result of this special construction technique is that it is no longer necessary to tie up large construction crews, and associated heavy equipment, for months at a time while various cast-in-place bridge components are formed, poured and cured section-by-section. All that is required is to ship the precast bridge components to the construction site and assemble them as previously described to fully construct the particular bridge in a matter of days instead of months.

The foregoing detailed description is to be clearly understood as being given by way of illustration and example only, the spirit and scope of the present invention being limited solely by the appended claims.

What is claimed is:

1. A method of rapidly fabricating a vertical load-supporting pier structure comprising the steps of:

positioning on the ground a base member having a vertical opening extending therethrough between upper and lower exterior side surface portions thereof;

drilling a foundation hole in the ground directly beneath the base member by extending a drilling structure downwardly through the vertical opening in the base member so that the foundation hole is continuous with the vertical opening;

positioning the lower end of an elongated pier member into the foundation hole and the vertical opening in the base member, wherein the pier member is laterally dimensioned to form an annular space between the interior side surfaces of the vertical opening in the base member and the foundation hole and the exterior surface of the lower end of the pier member;

after positioning the lower end of the pier member in the vertical opening of the base member and the foundation hole, filling the annular space with quick-setting grout material; and allowing the quick-setting grout material to harden.

2. The method of claim 1 wherein the base member is positioned on a previous base and is grout stabilized with a quick-setting grout material.

3. A method of rapidly fabricating a vertical load-supporting pier structure comprising the steps of:

positioning on the ground a base member having a vertical opening extending therethrough;

drilling a foundation hole in the ground directly beneath the base member by extending a drilling structure downwardly through the vertical opening in the base member so that the foundation hole is continuous with the vertical opening;

positioning the lower end of a tubular pier member into the foundation hole and the vertical opening in the base member, wherein the pier member is laterally dimensioned to form an annular space between the interior side surfaces of the vertical opening in the base member and the foundation hole and the exterior surface of the lower end of the pier member;

after positioning the lower end of the pier member in the vertical opening of the base member and the foundation hole, sequentially flowing a quick-setting grout material downwardly through the interior of the tubular pier member, out the lower end thereof and then upwardly to fill the annular space; and allowing the quick-setting grout material to harden.

4. The method of claim 3 further comprising the step, performed prior to the step of sequentially flowing a setting grout material, of filling the annular space with a loose aggregate material.

5. The method of claim 3 further comprising the step, performed prior to the step of sequentially flowing a quick-setting grout material, of filling the interior of the tubular pier member with a loose aggregate material.

6. The method of claim 5 wherein the step of sequentially flowing a quick-setting grout material is performed using a polymer concrete material.

7. The method of claim 3 wherein the base member is positioned on a previous base and grout stabilized with a quick-setting grout material.

8. A method of rapidly fabricating a vertical load supporting pier structure comprising the steps of:

positioning on the ground a base member having a vertical opening extending therethrough;

drilling a foundation hole in the ground directly beneath the base member by extending a drilling structure downwardly through the vertical opening in the base member so that the foundation hole is continuous with the vertical opening;

positioning the lower end of a tubular pier member into the foundation hole and the vertical opening in the base member, wherein the pier member is laterally dimensioned to form an annular space between the interior side surfaces of the vertical opening in the base member and the foundation hole and the exterior surface of the lower end of the pier member, after positioning the tubular pier member in the foundation hole and the vertical opening of the base member, coaxially positioning a tubular collar member over the pier member and on the base member, the collar member having an internal lateral dimension sized to form an annular space around the pier member therein so that the annular space in the collar member is continuous with the annular space around the lower end of the pier member in the base member and the foundation hole;

after positioning the pier member and the collar member, sequentially flowing a quick-setting grout material downwardly through the interior of the pier member, out the lower end thereof and upwards therefrom to fill the annular space in the foundation hole, the vertical opening of the base member and the collar member; and allowing the quick-setting grout to harden.

9. The method of claim 8 further comprising the step, performed prior to the step of sequentially flowing the quick-setting grout material, of filing the annular spaces with a loose aggregate material.

10. The method of claim 9 further comprising the step, performed prior to the step of sequentially flowing a quick-setting grout material, of filling the interior of the tubular pier member with a loose aggregate material.

11. The method of claim 10 wherein the step of sequentially flowing a quick-setting grout material is performed utilizing a polymer concrete material.

12. The method of claim 8 further comprising the step, performed prior to the step of sequentially flowing the quick-setting grout material, of:

inserting the upper ends of the collar member and the tubular pier member into a connection and support opening formed in the underside of a cap member, whereby the cap member is supported on the upper ends of said collar member and the tubular pier member; and wherein the step of sequentially flowing the quick-setting grout material is performed by injecting the grout material into the upper end of the tubular pier member through a fill opening in the pier cap member.

13. The method of claim 12 further comprising the step, performed prior to the step of sequentially flowing the quick-setting grout material, of filling the annular spaces with a loose aggregate material.

14. The method of claim 13 further comprising the step, performed prior to the step of sequentially flowing the quick-setting grout material, of filling the interior of the tubular pier member with a loose aggregate material.

15. The method of claim 14 wherein the step of sequentially flowing the quick-setting grout material is performed utilizing a polymer concrete material.

16. A pier structure for supporting a bridge above a vertical foundation hole in the ground, the structure comprising:

a base member positioned on the ground, the base member having a vertical opening extending therethrough continuous with the foundation hole in the ground;

a tubular pier member having a lower open end and a upper end, wherein the lower end is received through the vertical opening in the base member and extends a distance below the base member into the foundation hole, wherein the tubular pier member is laterally dimensioned to form with the interior side surfaces of the vertical opening in the base member and the foundation hole an annular space laterally circumscribing the tubular pier member; and grout material in the interior of the tubular pier member and the annular space around the tubular pier member in the foundation hole and in the vertical opening in the base member whereby the base member and the tubular pier member are rigidly connected together and whereby the lower end of the tubular pier member is rigidly supported in the foundation hole.

17. A method of rapidly interconnecting first and second abutting precast concrete structural bridge members and providing a structural connection therebetween, comprising the steps of:

forming in the first and second abutting precast concrete structural bridge members a duality of aligned holes which intercommunicate across the abutment surface region of the first and second abutting concrete members;

positioning opposite longitudinal portions of a rigid connecting member in the duality of aligned holes; and grouting the connecting member into place within the duality of aligned holes using a quick-setting grout material.

18. The method of claim 17 wherein the step of grouting the connecting member into place is performed using a polymer concrete material.

19. A method of rapidly interconnecting first and second abutting concrete members comprising the steps of:

forming in the first and second abutting concrete members a duality of aligned holes which intercommunicate across the abutment surface region of the first and second concrete members;

positioning opposite longitudinal portions of a rigid connecting member in the duality of aligned holes, wherein the connecting member comprises a pin member having a tubular configuration dimensioned to create with the aligned holes an annulus which laterally circumscribes the pin member; and grouting the connecting member into place within the duality of aligned holes using a quick-setting grout material by sequentially flowing the quick-setting grout material in a first direction through the interior of the connecting member, into the annulus through an open end of the pin member, and through the annulus in a second direction opposite from the first direction.

20. The method of claim 19 wherein the grouting step is performed utilizing a polymer concrete material.

21. A bridge structure comprising:

a pair of ground-supported vertical precast concrete pier members having upper end portions;

a precast concrete cap beam having a pair of longitudinally spaced openings on the underside thereof, each such opening receiving the upper end portion of one of the pair of pier members, the cap beam further having spaced along the length of its upper abutment surface a first series of spaced openings;

a plurality of precast concrete deck beams each having a lower abutment surface having openings near the ends thereof alignable with the first series of spaced openings in the upper abutment surface of the cap beam, and wherein each of the upper abutment surfaces of the deck beams is provided a second series of spaced openings;

a plurality of elongated, precast concrete deck slabs extending across and supported atop the deck beams and having a lower abutment surface with a third series of spaced openings alignable with the second series of spaced openings across the upper abutment surface of the deck beams;

structural connections between the deck beams and the cap beam and between the deck beams and the deck slabs, the structural connections each having longitudinal portions of a rigid connecting member grouted into place using a quick-setting grout in each of the first, second and third series of spaced openings and in the openings near the ends of the lower abutment surface of the deck beams.

22. The bridge structure of claim 21 wherein the quick-setting grout material is a polymer concrete material.

23. The bridge structure of claim 22 wherein the structural elements are formed of steel-reinforced Portland cement material.

24. A bridge structure comprising:

a spaced series of ground-supported vertical concrete pier structures having upper end portions;

a laterally spaced series of concrete deck beams spanning and supported on the upper end portions of the pier structures and structurally connected thereto by connecting members each extending into an aligned, facing duality of holes formed in one of the pier structure upper end portions and an abutting deck beam and set in place within its associated holes with a grout material; and a side-by-side series of elongated, precast concrete deck slabs extending transversely across and supported atop the deck beams and structurally connected thereto by connecting members each extending into an aligned, facing duality of holes formed in one of the deck beams and an abutting deck slab and set in place within its associated holes with a grout material.

25. The bridge structure of claim 24 further comprising:

upstanding precast concrete guardrail members anchored to outer end portions of the deck slab members by connecting members each extending into an aligned, facing duality of holes formed in one of said deck slabs and an abutting guard rail member and set in place within its associated holes with a grout material.

26. A bridge structure comprising:

a spaced series of ground-supported, upwardly projecting concrete pier structures having upper end portions;

a laterally spaced series of precast concrete deck beams spanning and supported on the upper end portions of the concrete pier structures and anchored thereto by connecting members each extending into an aligned, facing duality of holes formed in one of the pier structure--upper end portions and an abutting deck beam, each of said connecting members having a tubular configuration which defines with the interior side surfaces of its associated holes an annular space circumscribing the connecting member, and the annular space and the interior of the connecting member each being filled with grout material; and a side-by-side series of elongated, precast concrete deck slabs extending transversely across and supported atop the deck beams and anchored thereto by connecting members each extending into an aligned, facing duality of holes formed in one of the deck beams and an abutting deck slab and set in place within its associated holes with a grout material.

27. The bridge structure of claim 26 wherein the grout material is a polymer concrete material.

28. A bridge structure comprising:

an elevated roadway;

a series of roadway support assemblies, each comprising:

a ground-supported, precast concrete pier base beam having a plurality of longitudinally spaced vertical openings extending therethrough, each such vertical opening continuous with a foundation hole in the ground directly thereunder;

a plurality of elongated precast concrete vertical pier members each having a lower longitudinal portion extending downwardly through one of the vertical openings in the pier base beam and into its underlying foundation hole, and having an upper longitudinal portion projecting upwardly from the pier base beam and having an upper end, the lower longitudinal portion of each pier member being outwardly circumscribed by an annular space disposed within its associated pier base opening and foundation hole;

a plurality of cylindrical, precast concrete collar members each coaxially circumscribing one of the upper longitudinal pier member portions and defining therewith an upward extension of the annular space circumscribing its lower longitudinal portion, each of the collar members having a lower end portion received in one of the vertical openings in the pier base beam, and an upper end generally aligned with the upper end of its associated pier member;

a precast concrete pier cap beam having a longitudinally spaced plurality of underside openings each receiving upper end portions of a pier member and its associated collar member; and a grout material disposed within the annular spaces and extending vertically therein from the bottoms of the pier foundation holes to adjacent the top ends of the pier members.

29. The bridge structure of claim 28 further comprising a loose aggregate material interspersed and locked within the grout material positioned in the annular spaces and the upward extension thereof.

30. The bridge structure of claim 29 wherein the pier members have tubular configurations and are filled with a grout material.

31. The bridge structure of claim 30 further comprising a loose aggregate material interspersed and locked within the grout material positioned in the interiors of the pier members.

32. The bridge structure of claim 28 wherein the elevated roadway comprises interconnected precast concrete members.

33. A method of rapidly fabricating a load supporting pier structure comprising the steps of:

forming in the earth a generally vertically extending foundation hole;

positioning on the ground a base member having a vertical opening extending therethrough, the vertical opening being located over the foundation hole;

lowering a lower longitudinal portion of a tubular continuous one piece pier member into the foundation hole through the vertical opening in the base member until the pier member engages the bottom of the foundation hole, the tubular pier member being laterally dimensioned to form with the interior side surfaces of the vertical opening in the base member and the foundation hole an annular space laterally circumscribing the tubular pier member and extending upwardly from the lower end of the tubular pier member through the vertical opening in the base member; and sequentially flowing under pressure a quick-setting grout material downwardly through the interior of the tubular pier member, out the lower end thereof into the annular space, and upwardly through the annular space to adjacent the upper end thereof.

34. The method of claim 33 wherein the step of flowing a quick-setting grout material is performed using a polymer concrete material.

35. The method of claim 33 further comprising the step, performed prior to the step of flowing a quick-setting grout material, of filling the fill space with a loose aggregate material.

36. The method of claim 33 wherein the pier base member is positioned on a previous base and grout stabilized with a quick-setting grout material.

37. A method of rapidly fabricating a load supporting pier structure at a construction site, the method comprising:

interconnecting at the construction site a plurality of prefabricated structural components, wherein the prefabricated structural components comprise pier base beams, support pier structures and pier cap beams; and securing the interconnections between the prefabricated structural components with quick-setting grout.

38. The method of claim 37 wherein the quick-setting grout comprises polymer concrete.

39. The method of claim 37 wherein the prefabricated structural components are characterized as continuous length members formed of steel-reinforced concrete.

40. A method of rapidly fabricating a load supporting pier structure, the method comprising:

fabricating at a fabrication site a plurality of structural components, wherein the structural components comprise pier base beams, support pier structures and pier cap beams;

transporting the structural components to a construction site; and assembling the structural components at the construction site using quick-setting grout.

41. The method of claim 40 wherein the quick-setting grout comprises polymer concrete.

42. The method of claim 40 wherein the prefabricated structural components are characterized as continuous length members formed of steel-reinforced concrete.

* * * * *